United States Patent [19]

Nielsen

[11] Patent Number: 4,729,825

[45] Date of Patent: Mar. 8, 1988

[54] METHOD AND APPARATUS FOR CONTACTING FEED MATERIALS WITH FLUIDIZED SOLIDS

[75] Inventor: Richard H. Nielsen, Bartlesville, Okla.

[73] Assignee: Phillips Petroleum Company, Bartlesville, Okla.

[21] Appl. No.: 871,162

[22] Filed: May 30, 1986

Related U.S. Application Data

[63] Continuation of Ser. No. 720,203, Apr. 4, 1985, abandoned.

[51] Int. Cl.[4] ..... C10G 9/32; C10G 11/00

[52] U.S. Cl. ..... 208/154; 208/113; 208/127; 208/152; 208/153; 208/164; 208/DIG. 1

[58] Field of Search ..... 208/154, 157, 153, 156, 208/113, 152, 164, DIG. 1

[56] References Cited

U.S. PATENT DOCUMENTS

| | | | |
|---|---|---|---|
| Re. 28,974 | 9/1976 | Morgan et al. | 423/450 |
| 2,391,367 | 12/1945 | Hodgeson | 208/154 |
| 2,398,228 | 4/1946 | Hunt | 208/154 |
| 2,456,310 | 12/1948 | Orr | 208/154 |
| 2,701,231 | 2/1955 | Starr, Jr. | 208/154 |
| 2,786,801 | 3/1957 | McKinley et al. | 208/157 |
| 3,071,540 | 1/1963 | McMahon et al. | 208/163 |
| 3,150,832 | 9/1964 | Soth | 239/443 |
| 3,152,065 | 10/1964 | Sharp et al. | 208/157 |
| 3,528,611 | 9/1970 | Watson | 239/119 |
| 3,608,571 | 9/1971 | Wilcox | 137/81.5 |
| 3,654,140 | 4/1972 | Griffel et al. | 208/157 |
| 3,661,799 | 5/1972 | Cartmell | 208/164 |
| 4,128,051 | 12/1978 | Hildebolt | 99/348 |
| 4,186,877 | 2/1980 | Wilcox et al. | 239/124 |
| 4,195,779 | 4/1980 | Auclair et al. | 239/8 |
| 4,332,674 | 6/1982 | Dean et al. | 208/120 |
| 4,390,416 | 6/1983 | Ritter et al. | 208/113 |
| 4,394,324 | 7/1983 | Mark et al. | 208/113 |
| 4,405,444 | 9/1983 | Zandona | 208/113 |
| 4,418,049 | 11/1983 | Tillman | 423/450 |
| 4,427,537 | 1/1984 | Dean et al. | 208/157 |
| 4,434,049 | 2/1984 | Dean et al. | 208/157 |
| 4,446,009 | 5/1984 | Bartholic | 208/157 |
| 4,523,987 | 6/1985 | Penick | 208/157 |
| 4,578,183 | 3/1986 | Chou et al. | 208/153 |
| 4,675,099 | 6/1987 | Skraba | 208/164 |

*Primary Examiner*—Helen M. S. Sneed
*Assistant Examiner*—Anthony McFarlane
*Attorney, Agent, or Firm*—Williams, Phillips & Umphlett

[57] ABSTRACT

A method of feeding a mixture of fluidized solids, such as cracking catalyst, and a fluidized feed material to be contacted therewith, such as a hydrocarbon feedstock to be cracked, into a contacting zone. In another aspect, method and apparatus useful in starting up a catalytic cracking unit are disclosed.

15 Claims, 4 Drawing Figures

METHOD AND APPARATUS FOR CONTACTING FEED MATERIALS WITH FLUIDIZED SOLIDS

This is a continuation of application Ser. No. 720,203, filed Apr. 4, 1985, now abandoned.

The invention relates generally to improvements in method and apparatus for feeding fluidized solids and a fluid feed material to be contacted therewith into a contacting zone. In one aspect, the invention relates to method and apparatus for the operation of a catalytic cracking unit. In another aspect, the invention relates to the startup operations relating to feeding materials to the riser or transfer line in a fluid catalytic cracking unit.

High boiling oils are difficult to catalytically crack to gasoline range product in existing catalytic cracking operations. There are several reasons for this. The deposition of large amounts of coke on the catalyst will frequently bring the unit up to its coke burning capacity. Coke presursors are mole abundant in high boiling oils. Coke laydown is also caused by the deposition of metals on the cracking catalyst that increase the coking tendencies of the catalyst. The troublesome metals become concentrated in the high boiling oils. Coke laydown to a large extent is also influenced by poor vaporization of the oil prior to contact with the catalyst. High boiling oils are difficult to vaporize. Poor mixing between the cracking catalyst and oil feedstock also contributes to coke laydown on the catalyst, as poor mixing can lead to localized high catalyst: oil ratios and overcracking.

Heavy oils include heavy gas oils which generally boil from about 600° F. to 1200° F., and components such as topped crudes and residuum which may have an initial boiling point in excess of 850° F. and an end boiling point in excess of 1200° F. Generally speaking, heavy oils will have an initial boiling point in excess of 500° F. and a 90% overhead point in excess of 1000° F. Heavy gas oils, residuums and hydrotreated residuums are especially difficult to crack to valuable products because their boiling point makes satisfactory vaporization very difficult, their viscosity complicates handling and further complicates vaporization, metal contaminant concentration is usually quite high, the hydrogen:-carbon ratio is quite low and the concentration of carbon producing components such as polycyclic aromatics, asphaltenes and the like is very high. Feeds which contain components which have a boiling point in excess of 1050° F.+ are generally considered to be very poor fluid catalytic cracking feeds due to poor conversion to gasoline and lighter components, high coke production and excessive temperature levels in the regenerator.

Heavy oils can be successfully cracked to desirable products where they have been vaporized prior to contact with the catalyst and the catalyst:oil ratio is carefully controlled. With conventional feeds, vaporization is achieved by radiant and conductive energy transfer from the hot cracking catalyst to the feed droplets. This type of vaporization mechanism is satisfactory for oils boiling below thermal cracking temperatures which commence at about 850° F. For heavy oils, however, vaporization of large droplets by heat transfer is not completed prior to the onset of thermal cracking and coke formation. Coke laydown is worsened where liquid oil strikes the hot catalyst particles. It would be clearly desirable to provide an apparatus and process to mitigate contact between hot catalyst and liquid oil feed in a catalytic cracking unit.

It is an object of this invention to provide method and apparatus for contacting a fluid feed material with fluidized solids.

It is a further object of this invention to provide apparatus and method for starting up a catalytic cracking unit.

It is another object of this invention to provide a method and apparatus for initiating the mixing of a cracking catalyst and an oil feed in a catalytic cracking unit.

Another object of this invention apparatus and method is to insure optimum dilute phase contact between the catalyst and the oil feed in a catalytic cracking unit after unit start up.

It is a further object of this invention to provide method and apparatus for cracking an oil feed which operates effectively at low throughputs and with different feeds.

It is a further object of this invention to provide method and apparatus well adapted for fulfilling those objects enumerated above.

In one aspect, the present invention contemplates a method of feeding a mixture of fluidized solids and a fluid feed material to be contacted therewith into a contacting zone. The method comprises introducing a purging fluid at a purging fluid flow rate through atomization nozzle means upwardly into the contacting zone while maintaining a first predetermined fluid pressure upstream of the atomization nozzle means. The method also includes introducing a first fluidizing medium into a lower portion of a feeding zone, located below and in communication with the contacting zone, at a flow rate sufficient to fluidize solids in the feeding zone, to increase the velocity level of fluidized solids in the feeding zone and to move such fluidized solids to an upper portion of the feeding zone. The method further includes introducing a second fluidizing medium into the upper portion of the feeding zone at a flow rate sufficient to further increase the velocity level of fluidized solids in the feeding zone and to move such fluidized solids from the feeding zone into the contacting zone. Solids to be moved from the feeding zone as fluidized solids into the contacting zone are introduced into the feeding zone intermediate the upper and lower portions thereof. Upon the achievement of desired operating conditions in the contacting zone, fluid feed material to be contacted with the fluidized solids is introduced through the atomization nozzle means upwardly into the contacting zone at an increasing fluid feed material flow rate while simultaneously reducing the purging fluid flow rate and maintaining a second predetermined fluid pressure upstream of the atomization nozzle means until the achievement of 0% flow of purging fluid and 100% flow of fluid feed material through the atomization nozzle means into the contacting zone to contact the fluidized solids.

In another aspect, the present invention contemplates apparatus for feeding a mixture of fluidized solids and a fluid feed material to be contacted therewith. The apparatus comprises a lift pot having a longitudinal axis, an upper end portion, a lower end portion, and an interior surface, the upper end portion having an outlet therein, and the interior surface defining a contacting zone adjacent the upper end portion and a feeding zone located below and in contact with the contacting zone. The apparatus further includes solids inlet means in flow communication with the feeding zone for introducing solids into the feeding zone. The apparatus is also characterized by first fluidizing means located in the lower portion of the feeding zone for fluidizing solids in the feeding zone, increasing the velocity level of the fluidized solids in the feeding zone and moving such fluidized solids to an upper portion of the feeding zone. The apparatus is further characterized by second fluidizing means located in the upper portion of the feeding zone above the solids inlet means for further increasing the velocity level of fluidized solids in the feeding zone and moving such fluidized solids from the feeding zone into the contacting zone. The apparatus is further provided with atomization nozzle means in fluid flow communication with the interior of the lift pot for injecting atomized fluid upwardly into the contacting zone. The apparatus also comprises purging fluid conduit means in fluid flow communication between the atomization nozzle means and a source of purging fluid for providing a stream of purging fluid to the atomization nozzle means for passage therethrough into the contacting zone, and fluid feed material conduit means in fluid flow communication between the atomization nozzle means and a source of fluid feed material for providing a stream of fluid feed material to the atomization nozzle means for passage therethrough into the contacting zone. Pressure sensor means are operatively connected to the atomization nozzle means for monitoring the fluid pressure upstream of the atomization nozzle means and providing a pressure signal output responsive thereto. The apparatus further comprises flow controller means operatively connected to the pressure sensor means and operatively interposed in the purging fluid conduit means and in the fluid feed material conduit means for automatically reducing 100% purging fluid flow through the atomization nozzle means to 0% purging fluid flow through the atomization nozzle means while simultaneously automatically increasing 0% fluid feed material flow through the atomization nozzle means to 100% fluid feed material flow through the atomization nozzle means while maintaining a predetermined fluid pressure upstream of the atomization nozzle means.

BRIEF DESCRIPTION OF THE DRAWINGS

With reference to FIG. 1, one type of fluid catalytic cracking unit (FCCU) 2 comprises a reactor 4 and a regenerator 6. The reactor 4 comprises a riser reactor or transfer line reactor 7, a catalyst/product separation zone 8 which usually contains several cyclone separators, and a stripping section or zone 10 in which gas, usually steam such as introduced from line 12, strips entrained hydrocarbon from the coked catalyst, although the invention has applicability to transfer line reactors oriented other than vertically as well. Overhead product from the separation zone 8 is conveyed via line 14 to a separation zone 16 such as the main fractionator where it is separated, for example, into light hydrocarbons which are withdrawn from the zone 16 by the line 18, gasoline range liquids which are withdrawn by the line 20, distillates which are withdrawn by the line 22, and slurry oils, cycle oils, unreacted feed and the like which can be recycled in the recycle means 24 as required.

Figure 1:
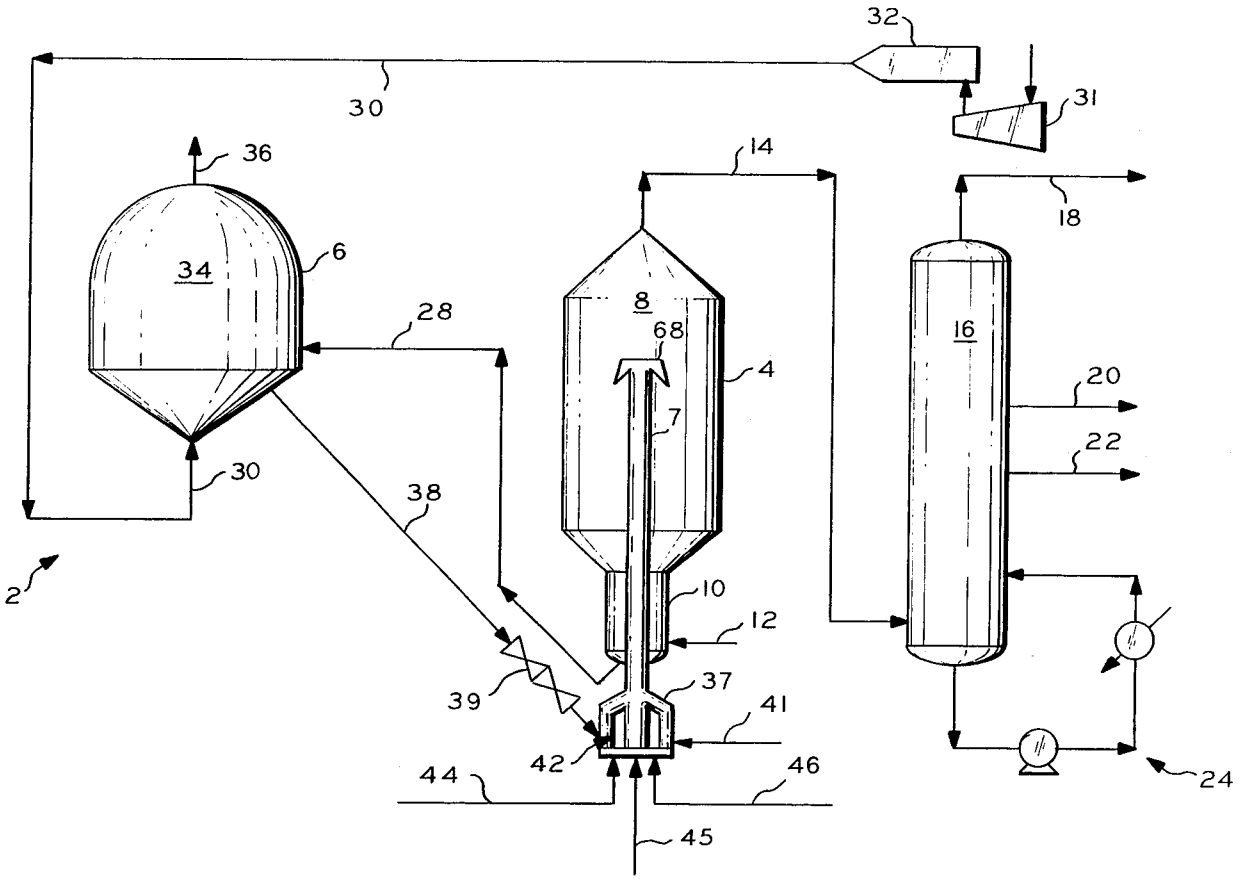
FIG. 1 illustrates schematically certain features of one type of catalytic cracking unit.

After being stripped in the zone 10, the cracking catalyst is conveyed from the zone 10 to the regenerator 6 by line 28 for coke burnoff. In the regenerator 6, oxygen containing gas is introduced by a line 30 which is connected to a source of oxygen containing gas such as the air compressor 31 and heater 32. Coke deposits are burned from the catalyst in the regenerator 6 forming an effluent gas which is separated from the catalyst in a separation portion 34 of the regenerator 6 which usually contains a plurality of cyclone separators. These flue gases are withdrawn from the regenerator 6 by the line 36. Hot regenerated catalyst passes from the regenerator 6 to a lift pot 37 at the lower end of the riser reactor 7 by line 38, which provides a source of hot cracking catalyst particles for the riser reactor.

The catalyst flow rate through the cracking unit is controlled by valves 39 which are positioned in the line 38, preferably in a vertical portion thereof.

In the lift pot 37, catalyst from the line 38 is fluidized with a fluidizing gas, usually steam, which is introduced into the lift pot 37 by line 41. The oil feedstock is introduced into the lift pot 37 via a nozzle cartridge assembly 42 which preferably emits a fine mist axially into the riser or transfer line ractor at the lower end thereof. A line 44 connects the nozzle cartridge assembly 42 with a source of heavy oil feedstock in the most preferred embodiment, although the invention can also be used to crack exclusively light oils if desired. A line 45 can then connect the nozzle cartridge assembly with a source of light gas oil, or the like. Atomizing gas such as steam can be added to the nozzle cartridge assembly 42 by line 46 which connects the nozzle cartridge assembly to a steam source.

The operating conditions for the riser reactor 7 and regenerator 6 can be conventional. Usually, the temperature in the riser reactor 7 will be in the range of from about 850° F. to about 1050° F. The oil is usually admixed with steam at a weight ratio of oil to steam in the range of from about 6:1 to about 25:1. A catalyst oil weight ratio employed in the riser reactor 7 is generally in the range of from about 2:1 to about 30:1, usually between about 3:1 and about 15:1. Pressure in the riser reactor 7 is usually between about 15 and about 60 psia (pounds per square inch absolute). The cracking catalyst particles generally have a size in the range of from about 20 to about 200 microns, usually between about 40 and 80 microns. Flow velocity upward in the vertical section of the riser reactor is generally from about 10 to 30 feet per second in the lower portions and up to between about 40 and about 120 feet per second in the upper portions. The contact time between the catalyst and oil in the riser reactor is generally in the range of from about 0.5 to about 4 seconds, usually from 1.0 to about 3 seconds when the oil is injected into the bottom of the riser. The regenerator is operated at a temperature typically in the range of from about 1100° F. to about 1500° F. and is ordinarily provided with sufficient oxygen containing gas to reduce the coke on the catalyst to a level of about 0.5 weight percent or less, preferably less than 0.1 weight percent.

Catalysts suitable for catalytic cracking include silica alumina or silica magnesia synthetic microspheres or ground gels and various natural clay-type or synthetic gel-type catalysts. Most preferably, fluidizable zeolite-containing cracking catalysts are employed. Such catalysts can contain from about 2 to about 30 percent based on total weight of zeolitic material, such as Y-zeolite, dispersed in a silica alumina matrix and have an equilibrium B.E.T. surface area in the range of 25–250 $m^2/g$ and a particle size chiefly in the range of 40 to 80 microns.

Figure 2:
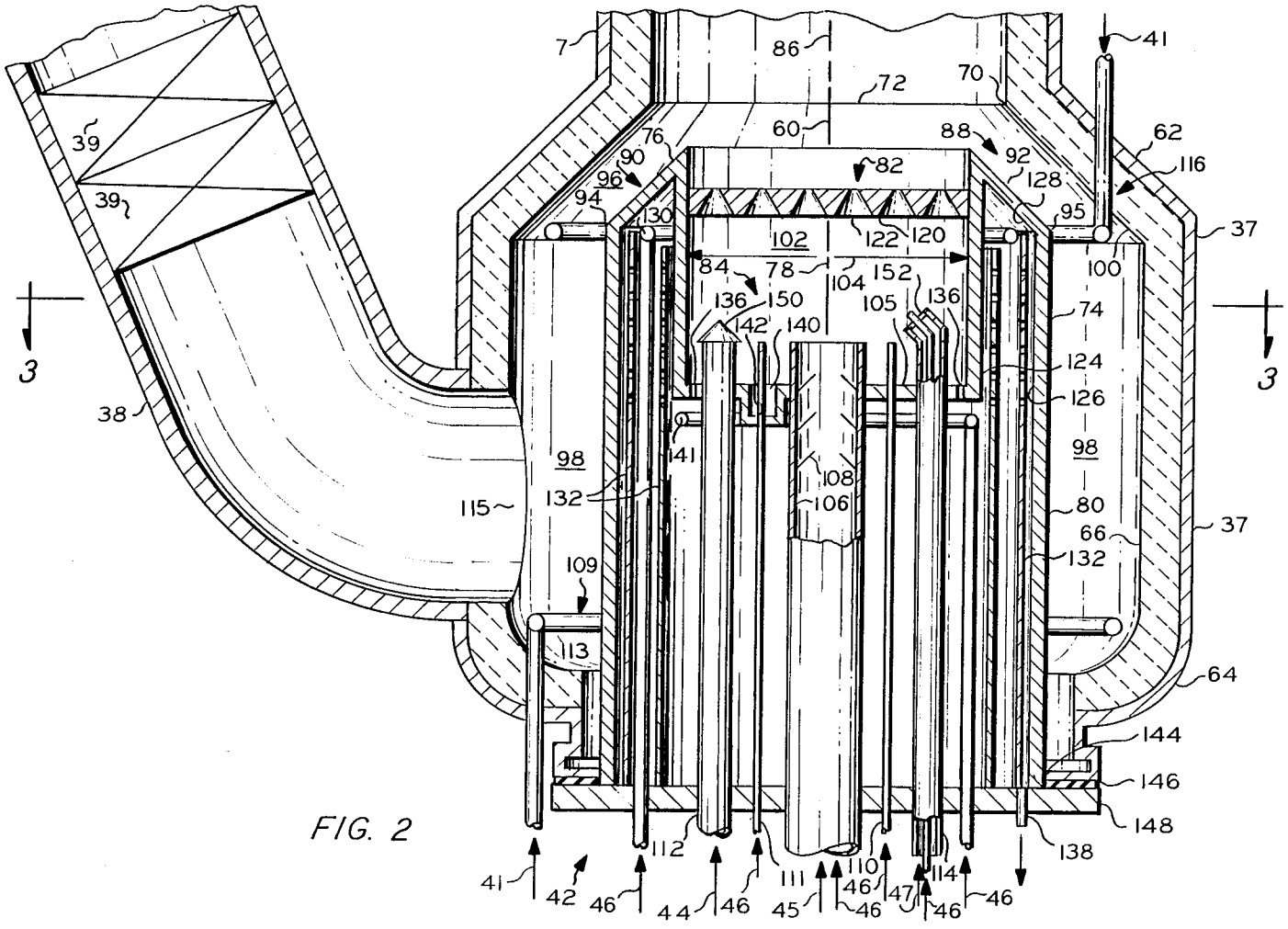
FIG. 2 illustrates schematically certain features of an embodiment of the present invention usefully employed in the system of FIG. 1.
Figure 3:
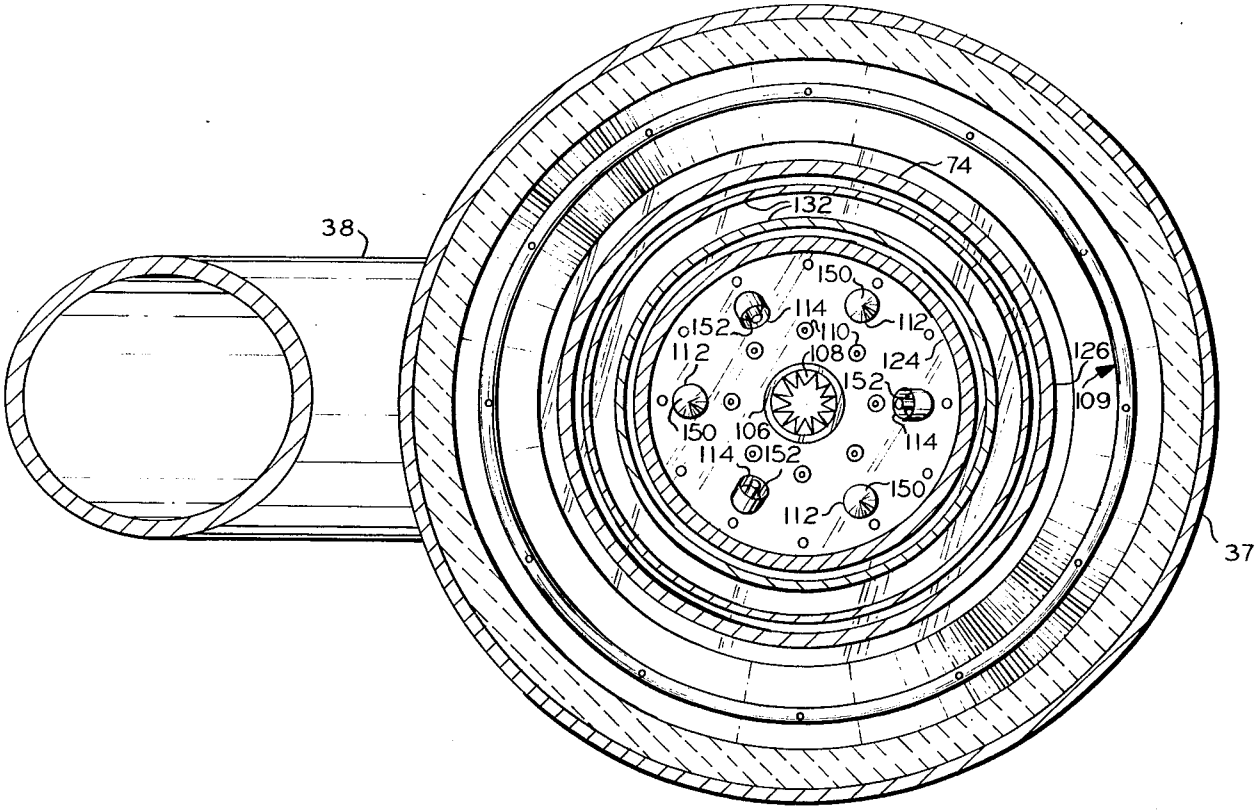
FIG. 3 schematically illustrates a cross section of the apparatus shown in FIG. 2 taken along line 3—3 of FIG. 2.

Referring now particularly to FIGS. 2 and 3, the catalyst lift pot 37 has a longitudinal axis 60, an upper end 62, a lower end 64 and an interior surface 66. Usually, the interior surface 66 will be formed from refractory to resist rapid erosion from the hot catalyst. The riser reactor 7 has an upper end 68 in FIG. 1, a lower end 70 in FIG. 2, with the lower end 70 being connected to the upper end 62 of the lift pot. The lower end 70 of the riser reactor 7 forms a mouth to the riser reactor and defines a diameter illustrated by the numeral 72. The nozzle assembly 42 comprises a tubular member 74 extending into the lift pot 37 from the lower end 64 of the lift pot. The tubular member 74 has an upper end 76, a longitudinal axis 78, an exterior surface 80 and an interior 82 which can be as described in greater detail hereinafter. Means 84 are provided for introducing a first material generally axially into the lower end 70 of the riser reactor 7, along a longitudinal axis 86 thereof. Means 88 are provided for introducing a second material into the lower end 70 of the riser reactor 7 from at least substantially the entire circumference of the first diameter 72. Preferably, the first material comprises an oil feedstock and the means 84 for introducing the first material into the riser reactor 7 is connected to a source of oil feedstock such as via lines 44 and 45. The second material comprises a hot fluidizable cracking catalyst and the means 88 for introducing the second material into the lower portion 70 of the riser 7 is connected to a source of hot fluidizable cracking catalyst such as the regenerator 6 such as via the line 38.

Generally speaking, the means 88 forming the flow path for the hot fluidizable cracking catalyst includes means 90 at the upper end 76 of the tubular member 74 for defining an upper surface 92 longitudinally spaced beneath the interior surface 66 at the upper end 62 of the catalyst lift pot 37. The upper surface 92 preferably defines a second diameter which can be as measured between points 94 and 95 which is larger than the first diameter 72. In this manner, a catalyst acceleration zone 96 can be defined between the upper surface 92 of the means 90 and the interior surface 66 of upper end 62 of the catalyst lift pot 37. Preferably, the upper end 76 of the tubular member 74 forms the means 90 and the second diameter, although these features could be formed by a flange or the end of a plug in a plug valve, for example.

Preferably, the exterior surface 80 of the tubular member 74 is generally cylindrical in shape and defines the second diameter although other shapes, such as frustoconical, would be very suitable. The interior surface 66 of the catalyst lift pot 37 also has a portion which is generally cylindrical and it defines a third diameter centered about the axis 60 which is preferably concentric with the diameter of the tubular member and the axis 78. In this manner, a catalyst lift chamber 98 is formed between the exterior surface 80 of the tubular member 74 and the interior surface 66 of the lift pot. Preferably, the catalyst lift chamber 98 has a generally annular cross section. The upper end 62 of the catalyst lift pot 37 is preferably formed by a wall 100 defining an inside surface which connects the generally cylindrical interior surface 66 of the catalyst lift pot 37 with the lower end 70 of the riser reactor. The upper end 76 of the tubular member 74 preferably defines a surface which is generally juxtaposed from the wall 100 and forms the means 90 for defining the upper surface longitudinally spaced beneath the upper end 62 of the catalyst lift pot 37. Preferably, the surface defined by means 90 is spaced beneath the inside surface defined by wall 100.

For ease of fabrication and good results, it is preferred that the inside surface of the wall 100 at the upper end 62 of the lift pot 37 connecting the generally cylindrical interior surface 66 of the catalyst lift pot 37 with the lower end 70 of the riser reactor 7 is generally frustoconical in shape. The inside surface of wall 100 preferably converges toward the longitudinal axis 86 of the riser reactor 7 at an angle as measured between the axis 86 and the inside surface of the wall 100 of between about 15 degrees and about 80 degrees. The surface 92 at the upper end 76 of the tubular member 74 is also preferably generally frustoconically shaped and converges toward the longitudinal axis 86 of the riser reactor 7 at an angle as measured between the longitudinal axis 86 and the surface 92 of between about 15 degrees and about 80 degrees. Preferably, the surfaces 92 and 100 converge toward the longitudinal axis 86 of the riser reactor 7 at an angle which is in the range of from about 30 degrees to about 75 degrees. The second diameter which is usually measured adjacent the upper end of the tubular member 74 is generally in the range of from about 1 to about 2 times the first diameter 72 defined by the lower end 70 of the riser. The radial inward component of catalyst velocity and vertical upward component of catalyst velocity can thus be determined easily by selection of the second diameter and the converging angle of the catalyst acceleration zone.

For atomization and vaporization of heavy oil feeds, the inside 82 of the tubular member 74 preferably forms a generally cylindrical atomization chamber 102. The chamber 102 is preferably provided with a fourth diameter 104 which is generally in the range of from about 0.3 to about 1.5, usually about 0.5 to about 1 times the diameter 72 at the mouth of the riser. The length of the atomization chamber 102 is preferably sufficient to provide an oil droplet size of below about 1000 microns. In practice, the desirable length as measured longitudinally for the chamber 102 will depend on steam and oil rates, oil viscosity, oil boiling point, nozzle type, and other parameters. Generally the length of the chamber 102 between the upper end 76 of the tubular member 74 and an atomization chamber end wall 105 spaced apart from the upper end 76 of the tubular member 74 is sufficient to provide the chamber 102 with a length to diameter ratio which is in the range of from about 1:10 to about 10:1, usually in the range of from about 1:3 to about 3:1. Pipes and tubular members preferably extend through the end wall 105 and empty into the atomization chamber 102 for supplying oil and atomization fluid into the chamber 102. Preferably, a central pipe 106 extends through the end wall 105 along the axis 78 thereof and empties into the atomization chamber 102. Turbulence generating members 108 which can be pentagonally shaped can desirably be mounted to the inside of the central pipe 106 for breaking up oil flow along the wall thereof where velocities are high enough to result in annular two-phase flow in the pipe 106. The central pipe 106 is preferably used to introduce gas oils into the chamber 102. A plurality of tubular members 110 can be circumferentially spaced apart around the central pipe 106 for emptying into the atomization chamber 102. Dispersal gas, usually steam, can be added into the chamber 102 through the tubular members 110. To achieve this, a source of atomizing fluid 46 can be connected to the tubular members 110. A source 45 of oil feedstock and a source of atomizing gas 46 can be connected to the central pipe 106. Other tubular members 112 and 114 can be circumferentially spaced apart around the central pipe 106 and extend longitudinally through the end wall 105 to empty into the atomization chamber 102. A source of oil feed 44 or 47 and/or atomizing gas 46 can be connected to these tubular members. In a preferred embodiment, the tubular members 112 carry a topped crude feedstock from a source 44 and are provided with a pressure atomizing nozzle. The tubular members 114 carry slurry oil from a source 47 in the outer tube and steam in the inner tube. The slurry oil is emitted generally axially from the outer tube through a C-shaped slot and is cut or sheared by steam from the inner tube flowing through a slot in the side of the inner tube which is normal to the C-shaped slot opening at the end of the outer tube through which the slurry oil flows. The tubular members 112 and the outer tubes of tubular members 114 are connected by suitable fluid flow control means to a source of purging fluid, preferably steam, and the respective sources of oil 44 and 47, as will be more fully described hereinafter.

Preferably, the cracking catalyst is fluidized prior to being mixed with the oil feed. For catalyst aeration or fluidization a means 109 is positioned in the catalyst lift chamber 98 for distributing a fluidizing gas such as steam from steam source 41 into the catalyst lift chamber adjacent a lower end 113 of the catalyst lift chamber 98. The line 38 preferably empties into the lift pot 37 through a port 115 through the sidewall of the lift pot opening between the means 109 and the catalyst acceleration zone 96 adjacent the upper end 62 of the lift pot. The means 109 preferably distributes fluidizing gas in the lower portion of lift pot to start vertically upward flow of the cracking catalyst. More preferably, a second means 116 for distributing a fluidizing gas such as steam from the source 41 is positioned in the catalyst lift chamber 98 at a position adjacent or below the catalyst acceleration zone 96. Usually, the means 109 and 116 will each be formed from an annular distributor having a sidewall with a plurality of ports therethrough which connects its interior with circumferentially spaced apart positions in the catalyst lift chamber 98. The ports through the sidewall of the annular distributor constituting the means 109 can be oriented downwardly or upwardly to lift the catalyst introduced into the catalyst lift chamber 98 via port 115 to the annular distributor constituting the means 116. The ports through the sidewall of the second means 116 will generally be oriented toward the upper end of the riser reactor. In this cracking catalyst can be conveyed in dilute phase at a desired velocity into the mouth 70 of the riser 7.

For certain applications, it can be desirable to position a partition 120 having a plurality of apertures 122 extending through it across the tubular member 74 between the end wall 105 of the tubular member and the upper end 76 of the tubular member. When the partition 120 is present, it will define the upper end of the atomization chamber 102. The apertures 122 should be relatively small and the partition 120 should be relatively thick. For example, the partition 120 can have a thickness in the range of from about 0.5 to about 10 inches and at least a portion of the apertures can have a diameter in the range of from about 0.05 to about 5 inches. Preferably, the apertures 122 each have a throat and converge from inlet diameter on the side of the atomization chamber 102 which is in the range of from about 0.25 to about 5 inches to a throat diameter which is in the range of from about 0.1 to about 3 inches. Generally speaking, sufficient apertures 122 will be provided so that the total aperture throat cross-sectional area will be in the range of from about 0.05 to about 0.5 times the cross-sectional area of the atomization chamber 102.

For certain other applications, it can be desirable to hollow out the sidewall of the tubular member 74 such as by forming the tubular member 74 by an inner wall member 124, an outer wall member 126 and an end wall member 128. The inner wall member defines the third diameter 104, the outer wall member defines the fourth diameter which can be measured between points 94 and 95 and the end wall member 128 defines the upper end 76 of the tubular member. The end wall 105 of the atomization chamber 102 is defined by a closure across the inside diameter of the inner wall member 124 of the tubular member 74. The biggest advantage to hollowing out the sidewall of the tubular member 74 instead of forming it from a solid material such as refractory is that it can be cooled by a flow of cooling fluid. For example, a source of steam 46 can be connected to the annulus between the inner wall member 124 and the outer wall member 126 so that cooling fluid flows in the annulus by the outer wall member 126 and the end wall 128 which connects the inner wall member 124 and the outer wall member 126. One manner for doing this is to provide an annular fluid distributor 130 having a sidewall and a plurality of ports through its sidewall at spaced apart positions along its length connected to the fluid source 46 and positioned in the annulus between the inner wall 124 and the outer wall 126 at a position closely adjacent the end wall member 128. To further reduce heat penetration from the catalyst lift chamber 98 to the atomization chamber 102, one or more radiation shielding members or baffles 132 can be positioned between the inner wall member 124 and the outer wall member 126. The radiation shielding members 132 provide radiation shielding between the wall members to reduce heat penetration into the atomization chamber 102 and the possibility of coke buildup. The radiation shielding members 132 can be in the form of tubular baffles extending circumferentially around and longitudinally through the annulus between the inner and outer wall members and this arrangement is presently preferred. The tubular baffles 132 are provided with apertures which are preferably radially nonaligned as between adjacent baffles so as to prevent or mitigate heat penetration by radiation. Other types of radiation shielding, such as bronze turnings, raschig rings and the like can be employed if desired. The cooling fluid introduced into the annulus between the inner wall member 124 and the outer wall member 126 can be introduced or exhausted into the riser if desired, such as through a plurality of ports 136 which extend through the end wall 105 defining the lower end of the atomization chamber 102, or they can be withdrawn or exhausted from the cracking unit such as via tube or port 138 which also is positioned in flow communication with the annulus. To further assist in oil dispersal and to shield the inner wall member 124 from oil impingement the ports 136 can open into the atomization chamber 102 through the end wall 105 around the periphery of the atomization chamber 102 closely adjacent to the inner wall member 124, or the steam can leak into the atomization chamber 102 between the feed tubes 112 and 114 and the end wall 105.

To obtain maximal cooling benefit from the fluid introduced into the hollowed-out portion of the tubular member, it is desirable that the fluid first flow past the inner wall member 124 and then the outer wall member 126. To accomplish this, the baffle 132 can be formed as a generally tubular partition positioned in the annulus between the inner wall member 124 and the outer wall member 126 in a spaced-apart position from the end wall 128 at the upper end of the tubular member to form an inner flow path adjacent the inner wall member and an outer flow path adjacent the outer wall member. Communication between the inner flow path and the outer flow path is established adjacent the end wall 128. The source of cooling fluid such as steam source 46 is connected to a lower portion of the inner flow path such as at annular distributor 141. Where the embodiment of the invention using upper distributor 130 is employed, the distributor 141 preferably exhausts directly into the atomization chamber 102.

The flow of atomizing gas can be controlled independently of the flow of feed oil. In accordance with this embodiment, there is provided extending through the end wall 105 of the atomization chamber 102 a means for introducing an atomizing fluid consisting essentially of steam into the atomization chamber 102. Generally speaking the means for introducing steam will be formed by a plurality of ducts such as the tubular members 110 and/or the ports 136. Preferably, the ducts will open into the atomization chamber 102 in a geometric array which is concentric with the longitudinal axis 78 of the atomization chamber. Usually, the ducts will be arranged along a circle. In any event, the ducts are connected to the steam source 46 and some means for controlling the flow of steam through the ducts, such as a valve, is provided in the steam line. The ducts should be positioned sufficiently close to the pipe 106 and oriented to help atomize the liquid which issues from the pipe 106.

In the event that liquid accumulation on the end wall 105 becomes a problem, a sump 140 can be recessed from the atomization chamber 102 into the end wall 105 of the atomization chamber 102 and the end wall 105 formed so that liquids accumulated thereon will flow into the sump 140. From the sump 140, accumulated liquids can be withdrawn from the cracking unit by means not shown or reatomized by a means associated with the sump 140 for atomizing accumulated liquids therein. In one embodiment, the means associated with the sump for atomizing accumulate liquids comprises a duct or port 142 opening into the sump 140 which is connected to the steam source 46 such as by a tubular member 111. Preferably, the tubular member 111 extends through the end wall 105 and into the atomization chamber 102 through the sump and has a sidewall which defines the port 142. The port 142 is located in the sump 140 so that liquids are aspirated out of the sump and emitted from the end of the tubular member in admixture with steam into the atomization chamber 102.

For maintenance purposes, it is very desirable that the assembly 42 be removable as a unit. One manner of providing for this is to form the lift pot 37 with a port 144 at its lower end adapted for receiving the generally cylindrical exterior surface 80 of the tubular member. A generally annular flange 146 is positioned around the port. The generally cylindrical exterior surface 80 of the tubular member is provided with a generally annular flange 148 mounted thereon sealingly contacting the generally annular flange 146 at the lower end of the lift pot.

Figure 4:
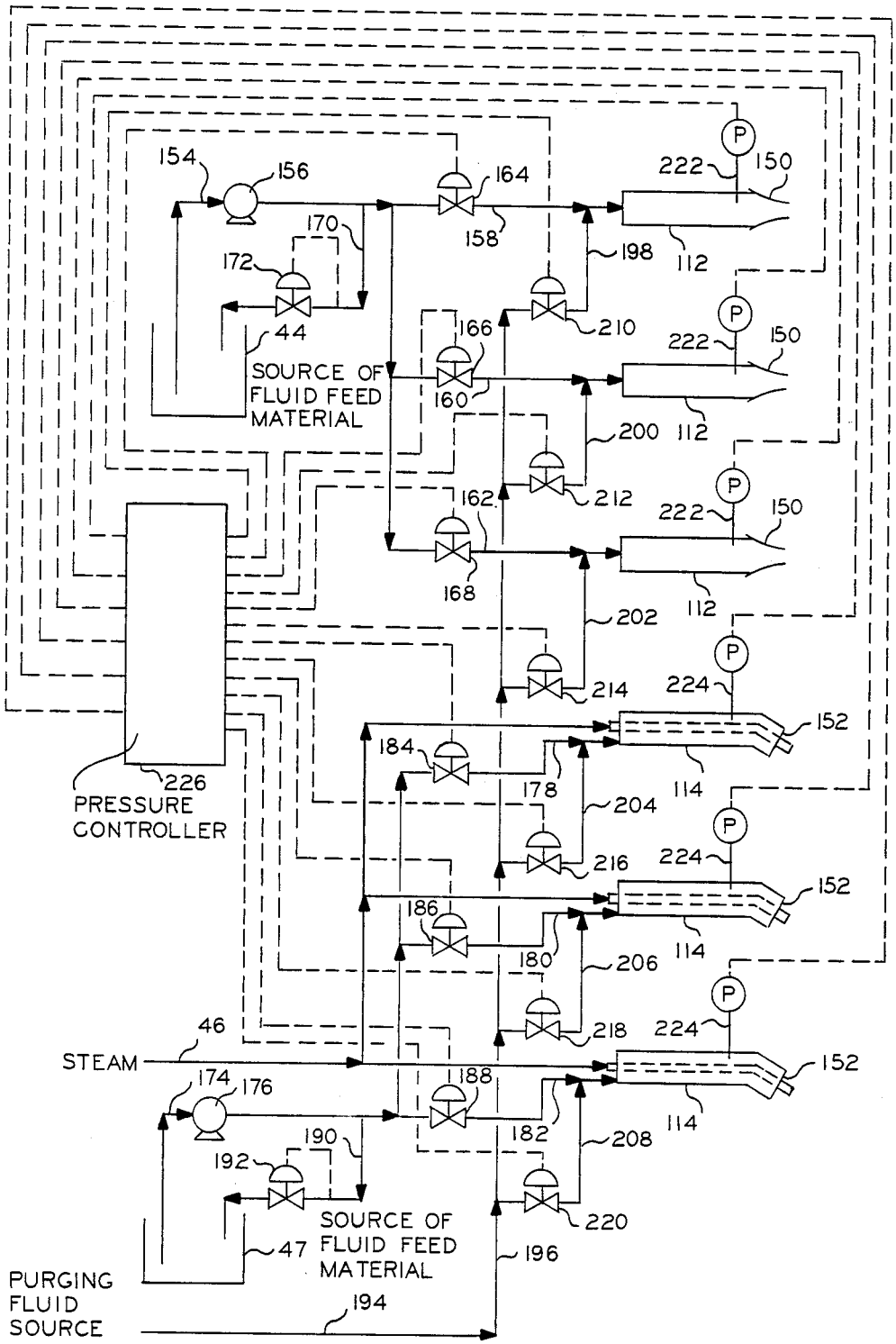
FIG. 4 schematically illustrates a control system constructed in accordance with the present invention.

Referring now to FIG. 4, there is schematically illustrated flow control means in the form of a control system constructed in accordance with the present invention. The control system provides means for automatically placing the atomization nozzle means comprising the pressure atomization nozzles 150 associated with the tubular members 112 and atomization nozzles 152 associated with the outer tube of the tubular members 114 into operation. Each of the atomization nozzles 150 and 152 provides a flow restriction at the upper or outer end thereof through which fluid feed material such as topped crude oil from source 44 and slurry oil from source 47 is passed into a contacting zone where such atomized fluid feed material is contacted with fluidized solids such as cracking catalyst. Atomizing fluids such as steam is provided from a source 46 to the inner tubes of tubular members 114 to shear the slurry oil flowing through the C-shaped slot restriction at the atomization nozzle 152.

In a preferred embodiment, topped crude oil is directed through the pressure atomization nozzles 150 via conduit 154, pump 156 interposed in conduit 154, conduits 158, 160 and 162 and tubular members 112. Flow control valves 164, 166 and 168 are interposed in conduits 158, 160 and 162, respectively. A return conduit 170, having a pressure relief valve 172 interposed therein, provides fluid flow communication between the source of fluid feed material 44 and conduit 154 downstream of pump 156.

Slurry oil is directed through the atomization nozzles 152 via conduit 174, pump 176 interposed in conduit 174, conduits 178, 180 and 182 and the outer tubes of tubular members 114. Flow control valves 184, 186 and 188 are interposed in conduits 178, 180 and 182, respectively. A return conduit 190, having a pressure relief valve 192 interposed at their end, provides fluid flow communication between the source of fluid feed material 47 and conduit 174 downstream of pump 176.

A source of purging fluid 194, such as steam, nitrogen or other suitable fluids, but preferably steam, is connected via conduits 196, 198, 200 and 202 and tubular members 112 to pressure atomization nozzles 150. The purging fluid source 194 is also connected via conduits 196, 204, 206 and 208 and the outer tubes of tubular members 114 to atomization nozzles 152. Flow control valves 210, 212, 214, 216, 218 and 220 are interposed in conduits 198, 200, 202, 204, 206 and 208, respectively.

Pressure sensors 222 are operatively connected to the pressure atomization nozzles 150 upstream of the flow restrictions therein. Similarly, pressure sensors 224 are operatively connected to the atomization nozzles 152 upstream of the flow restrictions therein. The pressure sensors 222 and 224 are each connected by a suitable corresponding conduit (dashed lines) to a suitable pressure controller 226. The flow control valves 164, 166, 168, 184, 186, 188, 210, 212, 214, 216, 218 and 220 are each connected by suitable corresponding conduits (dashed lines) to the pressure controller 226. Suitable pressure controllers for use in the control system of the present invention include programmable computer operated controllers capable of controlling the opening and closing of the flow control valves in response to one or more predetermined routines or programs and further in response to output signals received from the pressure sensors 222 and 224 which output signals are responsive to or represent the pressures sensed upstream of a flow restriction in a corresponding atomization nozzle 150 or 152.

The operation of the flow control system shown in FIG. 4 can be advantageously employed in a catalytic cracking system as described herein in detail. A presently preferred application of the flow control system is in the startup of a fluid catalytic cracking unit as described herein.

In the startup of a fluid catalytic cracking unit, it is necessary to gradually raise operating temperatures of the unit to predetermined operating levels while circulating cracking catalyst through the unit before introduction of various oil feedstocks into the unit. As these operating temperatures are increasing and the catalyst is circulating, it is necessary that the atomization nozzles 150 and 152 of tubular members 112 and 114 be protected from plugging or blockage by particles of circulating catalyst solids before atomization of hydrocarbon feedstocks into the contacting zone for contact with fluidized catalyst is initiated. To this end, suitable purging fluid is caused to flow through the atomization nozzles 150 and 152 before introduction of hydrocarbon feedstocks therethrough. Suitable purging fluids include gases or liquids the presence of which within the unit will not adversely affect its operation. A convenient, effective and presently preferred purging fluid is steam which can both add heat to the unit and maintain the desired clearance of the atomization nozzle flow restrictions during unit startup.

When operating temperatures of the catalytic cracking unit are achieved, it is desirable to change the flow of 100% purging fluid, e.g. steam, through the atomization nozzles to 100% heated hydrocarbon feedstocks flow through the atomization nozzles as quickly as possible without any pressure surges or hammering within the nozzles upstream of the flow restrictions therein. It is, for example, desirable to achieve this change in flow in no more than about 5 minutes, and preferably in no more than about 3 minutes.

Upon initiation of this flow change, the pressure controller 226 begins reducing the flow of purging steam to the atomization nozzles 150 and 152 by gradually causing the closing of the initially open purging fluid flow control valves 210, 212, 214, 216, 218 and 220, and simultaneously gradually opening the initially closed fluid feed material flow control valves 164, 166, 168, 184, 186 and 188 while maintaining the pressure immediately upstream of the flow restrictions in the atomization nozzles at a predetermined level until the purging fluid flow control valves are completely closed to provide 0% purging fluid flow and the fluid feed material flow control valves are open sufficiently to provide 100% flow of hydrocarbon feedstock through the atomization nozzles at the desired atomization nozzle pressure upstream of the flow restrictions therein. This flow change is performed by the pressure controller 226 within the above-mentioned predetermined time period. It is presently preferred that the pressure controller 226 causes the purging fluid flow control valves to move from their open positions to their fully closed positions within the predetermined time period while the opening of each of the initially closed fluid feed material flow control valves is controlled in response to the output signals received by the pressure controller 226 from the corresponding pressure sensors 222 and 224. It will be understood that it may be desirable under certain circumstances to control the closing of the purging fluid flow control valves in response to the output signals from the corresponding pressure sensors 222 and 224 and/or control the opening of the fluid feed material control valves within the predetermined time period.

The control system further contemplates maintaining the atomization nozzle pressures generally constant during this flow change, as well as either increasing or decreasing the atomization nozzle pressure as may be desired due to the characteristics of the fluid feed materials or other considerations. It will also be understood that the flow changes through the atomization nozzles can be accomplished simultaneously, individually or in any other suitable order as may be desirable. The control system also permits the utilization of any combination of atomization nozzles by changing the flow in some nozzles while maintaining purging fluid flow through others after unit startup.

It will be further understood that the flow change for each nozzle can be performed by manual control or manipulation of the associated flow control valves in response to human monitoring of the atomization nozzle pressure without the utilization of the pressure controller. The clear advantages of the use of the pressure controller 226 to achieve the desired flow changes simultaneously through multiple atomization nozzles in a minimum time period will be readily apparent to those skilled in the art.

There is further provided a method for mixing a particulate solid, usually a cracking catalyst, and a liquid feedstock, usually an oil. The method comprises introducing one of the liquid feedstock and the particulate solid generally axially into the mouth of a line reactor, and introducing the other of the liquid feedstock and the particulate solid into the mouth of the line reactor from substantially the entire circumference of the mouth of the line reactor. Preferably, the liquid oil feedstock is introduced generally axially into the mouth of a riser reactor and a fluidized particulate cracking catalyst is introduced into the mouth of the riser from substantially the entire circumference of the mouth of the riser. Usually, each of the liquid oil feedstock and the particulate catalyst will be in admixture with atomizing and fluidizing gas respectively, usually steam in both instances. In order to reduce the probability of liquid oil droplets striking hot cracking catalyst particles, it is desirable that the liquid oil feedstock and catalyst particles merge together at about the same velocity. Therefore, the particulate catalyst is preferably introduced into the riser with an axial velocity component which is about the same as the axial velocity of the liquid oil feedstock, where axial refers to the axis of the riser or transfer line, which is preferably vertically oriented. In this manner, catalyst slippage at the point of mixing with the feedstock, that is, substantial slippage prior to vaporization of the feed, can be substantially prevented.

Preferably, the particulate solid comprises a fluid catalytic cracking catalyst which will have a particle size primarily in the range of from about 20 to about 200 microns, usually in the range of from about 40 to about 80 microns. The liquid oil feedstock will generally comprise a petroleum oil having boiling point in the range of from about 600° F. to about 1200° F.+ and be introduced into the riser so as to provide a catalyst:oil weight ratio in the range of from about 2:1 to about 20:1. The liquid oil feedstock is preferably introduced generally axially into the mouth of the riser from a generally cylindrical atomization chamber positioned in general axial alignment with the riser and the fluidized cracking catalyst is usually introduced into the mouth of the riser from a catalyst lift chamber annularly positioned around the atomization chamber and physically separated from the atomization chamber. The catalyst lift chamber empties into the mouth of the riser along the circumference of the mouth. In this manner, the oil feedstock can be introduced into the mouth of the riser in atomized form with the droplet size being less than 1000 microns, preferably principally in the range of from about 5 to about 500 microns, having been atomized by being sprayed into an atomization chamber axially aligned with the mouth of the riser. The fluidized cracking catalyst is flowed into the stream of atomized oil feedstock with a substantial radially inward velocity component from the periphery of the stream. Preferably, the fluidized cracking catalyst enters the stream of atomized oil feedstock at an acute angle of between about 45 degrees and about near 90 degrees with respect to the flow axis of the atomized oil feedstock. Preferably, steam is injected into the generally annularly shaped cloud of fluidized cracking catalyst slightly upstream of its entry into the mouth to both dilute and impart a radially inward velocity component to the cracking catalyst, since steam injection at this point can aid in forming a vortex of cracking catalyst particles and atomized oil feedstock traveling up the riser. By accelerating the catalyst in three stages, a uniform dilute phase of catalyst can be achieved. For example, the catalyst can be accelerated to 3–10 fps by the bottom steam ring, 5–15 fps by the top steam ring and 10–25 fps by the annular venturi.

Generally, the cracking catalyst will be introduced into the catalyst lift chamber at a temperature in the range of from about 1000° F. to about 1700° F. and the atomization and fluidization steam will be at a temperature in the range of from about 300° F. to about 1000° F. The oil will typically have been preheated to a temperature in the range of from about 200° F. to about 800° F.

At times, it can be desirable to flow the oil feedstock and atomizing gas through a partition positioned in axial alignment with the mouth of the riser. The partition when present has a plurality of apertures therethrough which function as venturis to provide better dispersion of the oil and steam and smaller droplet size. Steam can be used as the atomizing gas with a pressure ratio across the venturi high enough to give critical flow, for example, 2 or more. Where oil impingement coalesces on the bottom of the partition or the sidewall of the oil cartridge, it can be collected in a sump positioned at the bottom of the atomization chamber and reaspirated by a tube carrying atomizing gas for emission back into the atomization zone. To reduce the possibility of coke formations on the inside walls of the atomization chamber, the atomization chamber and catalyst lift chamber can be physically separated by a hollowed out wall and a cooling fluid circulated through the hollow wall. If desired, at least a portion of the cooling fluid can be withdrawn from the hollow wall and at least a portion of it injected into the atomization chamber. Preferably, the cooling fluid comprises steam in which event a stream of steam is injected into the atomization chamber separate from the liquid oil feedstock. If desired, a separate steam stream can be introduced into the atomization chamber alternatively or in addition to the steam entering the atomization chamber from the hollowed out wall. For good distribution of the separate steam stream, they can be introduced into the atomization chamber at circumferentially spaced apart positions in the chamber. One or more radiation shield members can be positioned in the hollow wall and the cooling fluid circulated around the radiation shield members to further reduce heat leak through from the catalyst lift chamber into the atomization zone.

Changes may be made in the combination and arrangement of parts or elements as heretofore set forth in the specification and shown in the drawings without departing from the spirit and scope of the invention as described herein.

I claim:

1. A method of feeding a mixture of fluidized solids and a fluid feed material into a contacting zone to contact, said fluid feed material with said fluidized solids under cracking conditions, which comprises:

(a) introducing a purging fluid consisting essentially of steam at a purging fluid flow rate through atomization nozzle means upwardly into said contacting zone while maintaining a fluid pressure upstream of said atomization nozzle means to force fluid through the said atomization nozzle means;

(b) introducing a first fluidizing medium into a lower portion of a feeding zone, located below and in communication with said contacting zone, at a flow rate sufficient to fluidize solids in said feeding zone, to increase the velocity level of fluidized solids in said feeding zone and to move said fluidized solids to an upper portion of said feeding zone;

(c) introducing a second fluidizing medium into said upper portion of said feeding zone at a flow rate sufficient to further increase the velocity level of fluidized solids in said feeding zone and to move said fluidized solids from said feeding zone into said contacting zone;

(d) introducing solids into said feeding zone, intermediate said upper and lower portions thereof, whereby said solids are fluidized and moved from said feeding zone as fluidized solids into said contacting zone by said first fluidizing medium and said second fluidizing medium; and (e) upon the achievement of desired operating conditions in said contacting zone, introducing said fluid feed material through said atomization nozzle means upwardly into said contacting zone at an increasing fluid feed material flow rate while simultaneously reducing said purging fluid flow rate and controlling said fluid pressure upstream of said atomization nozzle means until the achievement of 0% flow of said purging fluid and 100% flow of said fluid feed material through said atomization nozzle means into said contacting zone to contact said fluidized solids.

2. A method in accordance with claim 1 wherein step (e) is accomplished within a time period of no more than about 5 minutes.

3. A method in accordance with claim 2 wherein said time period is no more than about 3 minutes.

4. A method in accordance with claim 1 wherein said fluid pressure upstream of said atomization nozzle means is controlled to remain generally constant during step (e).

5. A method in accordance with claim 1 wherein said step of controlling said fluid pressure upstream of said atomization nozzle means during step (e) comprises increasing said fluid pressure upstream of said atomization nozzle means, and alternately, decreasing said fluid pressure upstream of said atomization nozzle means.

6. A method in accordance with claim 1 wherein said step of controlling said fluid pressure upstream of said atomization nozzle means during step (e) comprises increasing said fluid pressure upstream of said atomization nozzle means.

7. A method in accordance with claim 1 wherein said step of controlling said fluid pressure upstream of said atomization nozzle means during step (e) comprises decreasing said fluid pressure upstream of said atomization nozzle means.

8. A method in accordance with claim 1 wherein said fluid feed material is an oil and said solids comprise cracking catalyst.

9. A method in accordance with claim 8 wherein said oil comprises topped crude.

10. A method in accordance with claim 8 wherein said oil comprises slurry oil.

11. A method in accordance with claim 8 wherein said desired operating conditions in said contacting zone include the temperature of said cracking catalyst in said contacting zone and the temperature of said oil both being high enough to achieve the desired cracking of said oil when contacting said cracking catalyst.

12. A method in accordance with claim 1 wherein step (e) is performed by continuously monitoring said fluid pressure upstream of said atomization nozzle means and adjusting the increase in fluid feed material flow rate in response to said thus monitored fluid pressure as the purging fluid flow rate decreases.

13. A method in accordance with claim 1 wherein step (e) is performed by continuously monitoring said fluid pressure upstream of said atomization nozzle means and adjusting the decrease in purging fluid flow rate in response to said thus monitored fluid pressure as the fluid feed material flow rate increases.

14. A method in accordance with claim 1 wherein step (a) is characterized further to include introducing dispersal fluid upwardly into said contacting zone.

15. A method in accordance with claim 14 wherein said first fluidizing medium, said second fluidizing medium and said dispersal fluid comprise steam.

* * * * *